US008511935B1

(12) United States Patent
Thomas

(10) Patent No.: US 8,511,935 B1
(45) Date of Patent: Aug. 20, 2013

(54) PAVEMENT DOWEL ASSEMBLY BAR

(76) Inventor: James Thomas, Alexandria, KY (US)

( * ) Notice: Subject to any disclaimer, the term of this patent is extended or adjusted under 35 U.S.C. 154(b) by 13 days.

(21) Appl. No.: 13/370,914

(22) Filed: Feb. 10, 2012

(51) Int. Cl.
*E01C 11/18* (2006.01)

(52) U.S. Cl.
USPC ..... 404/135; 404/136; 52/678; 52/684

(58) Field of Classification Search
USPC ..... 52/677, 678, 684; 404/135, 136
See application file for complete search history.

(56) References Cited

U.S. PATENT DOCUMENTS

| | | | | | |
|---|---|---|---|---|---|
| 1,621,183 | A | * | 3/1927 | White | 52/684 |
| 1,863,115 | A | * | 6/1932 | Heltzel | 404/136 |
| 1,954,301 | A | * | 4/1934 | Torkelson | 404/135 |
| 2,296,195 | A | * | 9/1942 | Varner | 404/62 |
| 2,837,985 | A | * | 6/1958 | Swanson | 404/135 |
| 3,702,093 | A | | 11/1972 | Van de Loock et al. | |
| 3,722,164 | A | * | 3/1973 | Schmidgall | 52/684 |
| 4,689,867 | A | | 9/1987 | Tolliver | |
| 4,996,816 | A | | 3/1991 | Wiebe | |
| 5,832,690 | A | * | 11/1998 | Kaines | 52/677 |
| 6,171,016 | B1 | | 1/2001 | Pauls et al. | |
| 7,404,691 | B2 | | 7/2008 | Bennett et al. | |

OTHER PUBLICATIONS

Evaluating and Optimizing Dowel Bar Alignment; Concrete Pavement Research and Technology Special Report, American Concrete Pavement Association, Aug. 2006, 8 pages.
FHWA Approves New Infrastructure Technology, Dec. 8, 2011, www.itsinternational.com/news/article.ctm?recordID=21012.
Guide to Dowel Load Transfer Systems for Jointed Concrete Pavements, National Concrete Pavement Technology, Center, National Concrete Consortium, Iowa State University, Apr. 2011, 33 pages.
NCHRP Report 637, Guidelines for Dowel Alignment in Concrete Pavements, National Cooperative Highway Research Program, Transportation Research Board of the National Academies, Feb. 2009, 59 pages.

* cited by examiner

*Primary Examiner* — Gary Hartmann
(74) *Attorney, Agent, or Firm* — Wood, Herron & Evans, LLP

(57) ABSTRACT

A pavement dowel bar assembly is reinforced to maintain the alignment of dowel bars during the paving process. An exemplary dowel bar assembly includes a side frame having at least one bracing member. The bracing member is convertible between a first, stored position and a second, deployed position. When in the first, stored position, the bracing member is generally parallel to a plane defined by the side frame. In the second, deployed position, the bracing member is at an angle relative to the plane of the side frame. The dowel bar assembly may further include a plurality of dowel bars and a second side frame. Also described herein are methods of reinforcing a pavement dowel bar assembly with a convertible bracing member.

20 Claims, 10 Drawing Sheets

PAVEMENT DOWEL ASSEMBLY BAR

FIELD

The present disclosure relates generally to concrete pavement construction, and more particularly, to a dowel bar assembly used in the construction of concrete pavement.

BACKGROUND

Dowel bars are embedded in pavement to transfer loads across a joint from one slab of concrete pavement to the next. Adjacent slabs may be created in a continuous slab of pavement by sawing a slot in the pavement before the concrete is completely set so as to result in the controlled cracking of the pavement at the desired location for a contraction joint. Once the controlled cracking occurs, the concrete acts as somewhat independent slabs lying next to one another. Adjacent slabs may also be constructed by placing a piece of compressible expansion material that extends through the full thickness of the slab at the desired location for an expansion joint. Regardless of joint type, dowel bars are typically embedded at about mid-depth of the slabs across the location of the joint. The dowel bars provide sheer strength so that a load, such as from a vehicle, is transferred from slab to slab across the joint. The dowel bars must also provide lateral movement in the longitudinal direction to allow for the slabs to move for thermal expansion and contraction. To allow the slabs to move independently, the dowel bars are coated with a bond breaker before being embedded in the concrete slab so that when the concrete hardens, the dowels will allow the slabs to slide longitudinally during thermal contraction and expansion. In order for the mechanics of the expansion and contraction to function properly, the dowels must be aligned parallel to the surface of the pavement and also parallel to the longitudinal direction of movement. The allowable tolerance for dowel bar alignment is small. Should the dowel bars not be aligned within tolerance, independent movement of the slabs may be restricted causing the slabs to lock together at the joint. Joints that are locked up create high tension stresses within the concrete pavement and can cause premature failures.

One method for installing dowel bars in pavement is to use a dowel bar assembly that includes side frame for supporting a dowel bar in the necessary orientation prior to placing a concrete slab. Typically, a dowel bar assembly is positioned and anchored in an area where two slabs of pavement will abut one another. The dowel bar assembly is then paved over with concrete, such as by slip forming or using forms and striking off the surface with a paver or screed type device. After paving, a slot is cut or formed in the surface of the pavement at the desired location which creates a weakened vertical plane to control the location of the shrinkage crack to form a contraction joint. At locations where expansion joints are desired, a compressible material such as cork or asphalt impregnated fiber board with a typical thickness of ½-inch to 1-inch, spanning the pavement width and full thickness of the pavement is made a part of the dowel bar assembly and is located at the mid-point of the dowel. This expansion material creates complete separation between adjacent slabs and provides for horizontal expansion of the pavement resulting from thermal expansion. Regardless of joint type, dowel bars are used to transfer loads between adjacent slabs of pavement and the dowel bars must be properly aligned to perform this function.

Until recently, there was no effective method for determining if dowel bars in slabs of concrete were properly aligned. Researchers at the Massachusetts Institute of Technology developed a device which uses ground penetrating radar to accurately and efficiently determine dowel bar location within a hardened slab of pavement. The use of this device is becoming more widespread, which is bringing to light the magnitude and severity of dowel bar miss-alignment. Correcting miss-aligned dowel bars requires removal and replacement of the affected pavement which is very costly and disruptive to construction projects.

SUMMARY

While the invention will be described in connection with certain embodiments, it will be understood that the invention is not limited to these embodiments. On the contrary, the invention includes all alternatives, modifications and equivalents as may be included within the spirit and scope of the present invention.

Dowel bars can be miss-aligned for several reasons. The dowel bar assembly can be set incorrectly or the dowel bar assembly may become miss-aligned during paving. For example, a concrete paver can snag the dowel bar assembly during paving and pull it loose from anchoring. Dowel bar assemblies can also be pushed or collapsed from the significant forces caused by the paving process. Slip form paving concrete typically has a slump of 1 inch or less, meaning it is very dry concrete. This is necessary for slip form paving to work as it requires the side of the pavement to stand up vertically behind the paver without a form. Slip form pavers utilize an extrusion technique of squeezing the concrete beneath the paver so that it comes out of the back of the paver in the desired shaped. The action of extruding very dry concrete beneath the heavy paver places a great amount of force on the dowel bar assembly, which can cause it to collapse. Dowel bar assemblies are subjected to similar forces during other types of paving techniques as well, such as techniques that use forms and strike off the surface of the pavement with a paver or screed type device. Devices and methods are needed to maintain the alignment of dowel bars during the paving process.

An aspect of the invention is directed to a concrete pavement dowel bar assembly reinforced to maintain the alignment of dowel bars during the paving process. The dowel bar assembly includes a side frame having at least one bracing member. The bracing member is convertible between a first, stored position and a second, deployed position. When in the first, stored position, the bracing member is generally parallel to a plane defined by the side frame. When in the second, deployed position, the bracing member is at an angle relative to the plane of the side frame. The dowel bar assembly may further include a plurality of dowel bars and a second side frame. Also described herein are methods of reinforcing a pavement dowel bar assembly with a convertible bracing member.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the principles of the invention.

DETAILED DESCRIPTION

Figure 1A:
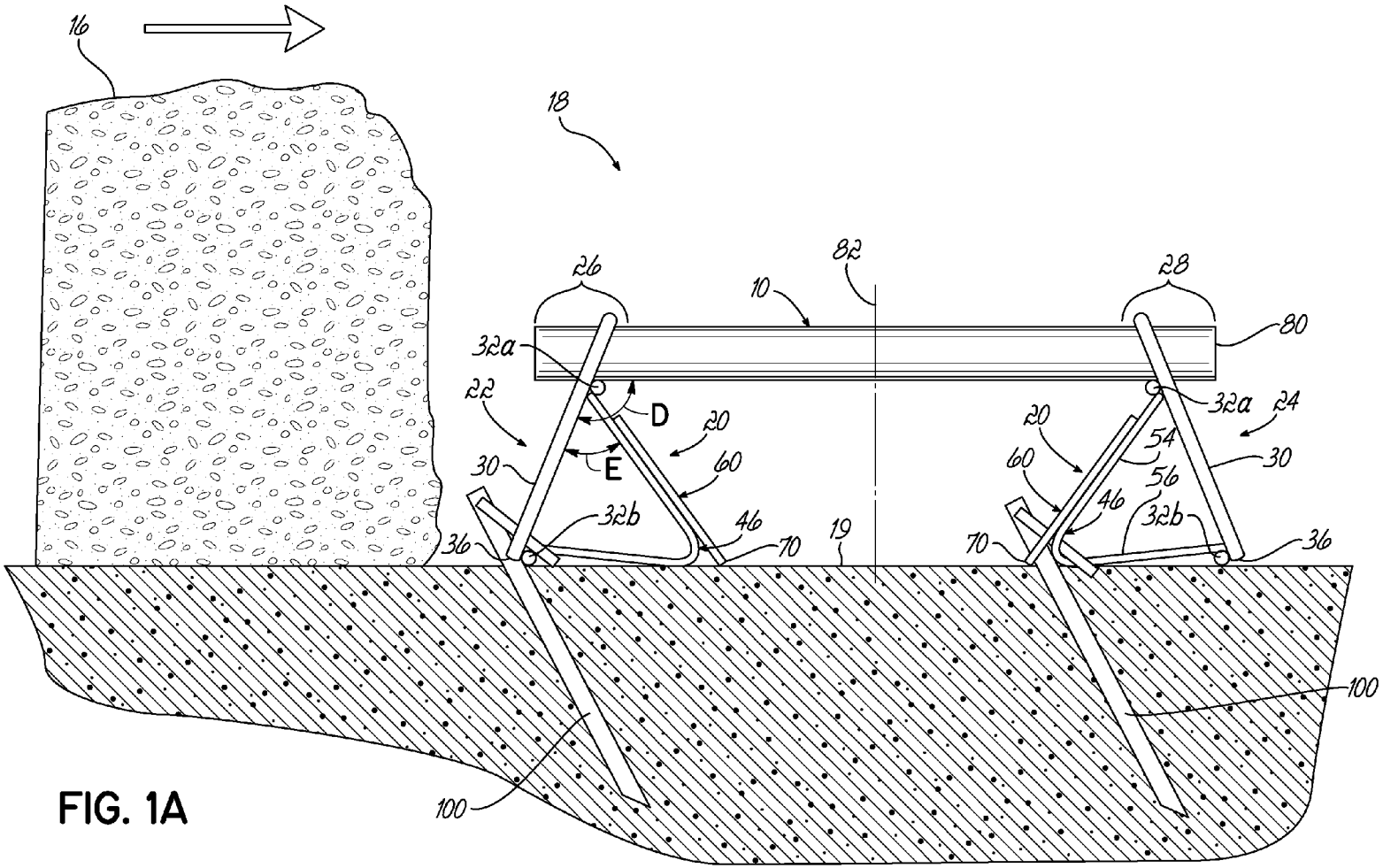
FIG. 1A is a front elevation view in partial cross section of an embodiment of a dowel bar assembly during the paving process in accordance with aspects of the invention.
Figure 1B:
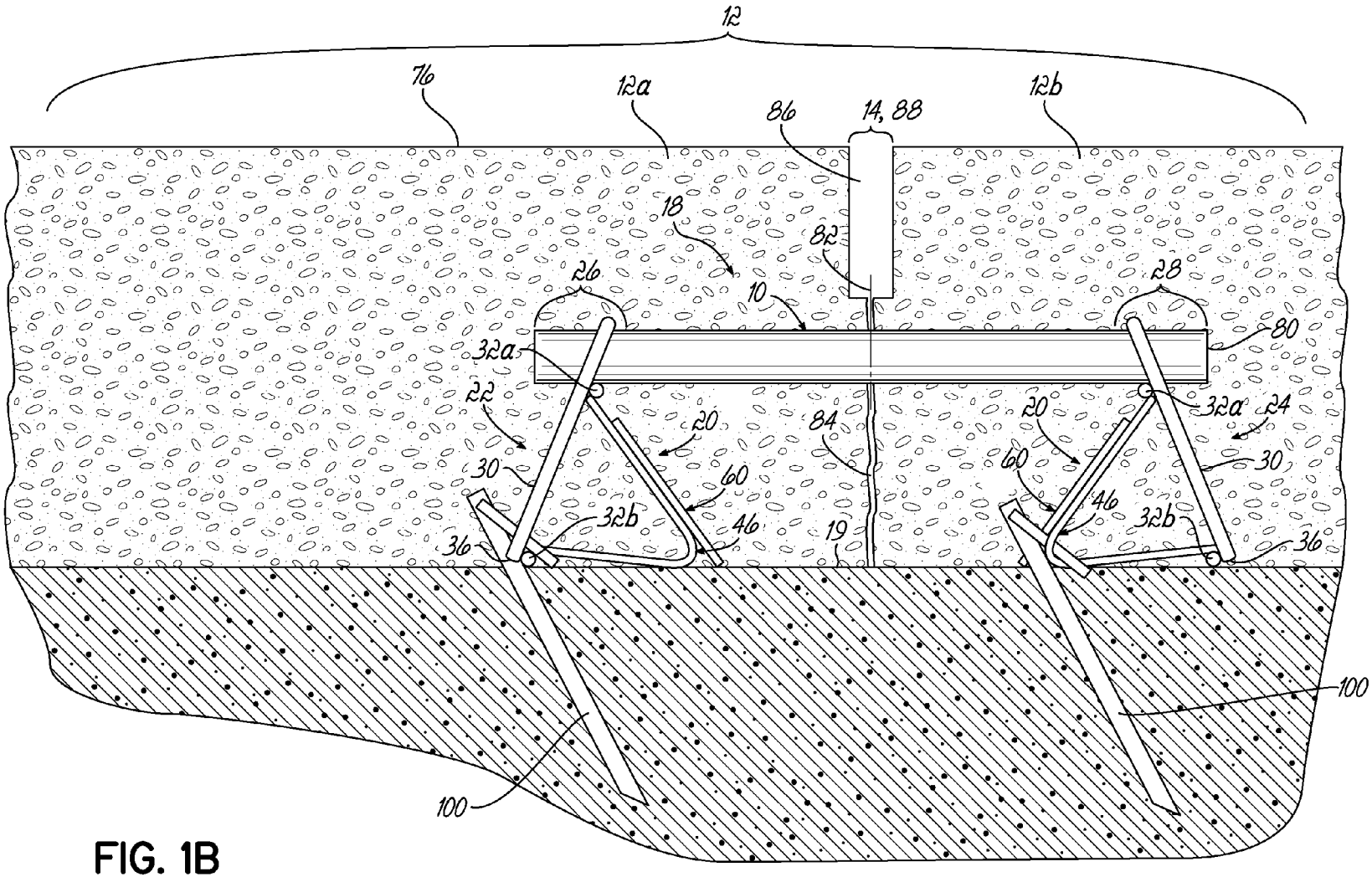
FIG. 1B is a front elevation view in partial cross sectional of an embodiment of a dowel bar assembly with dowel bars extending across a contraction joint between two slabs of pavement in accordance with aspects of the invention.
Figure 1C:
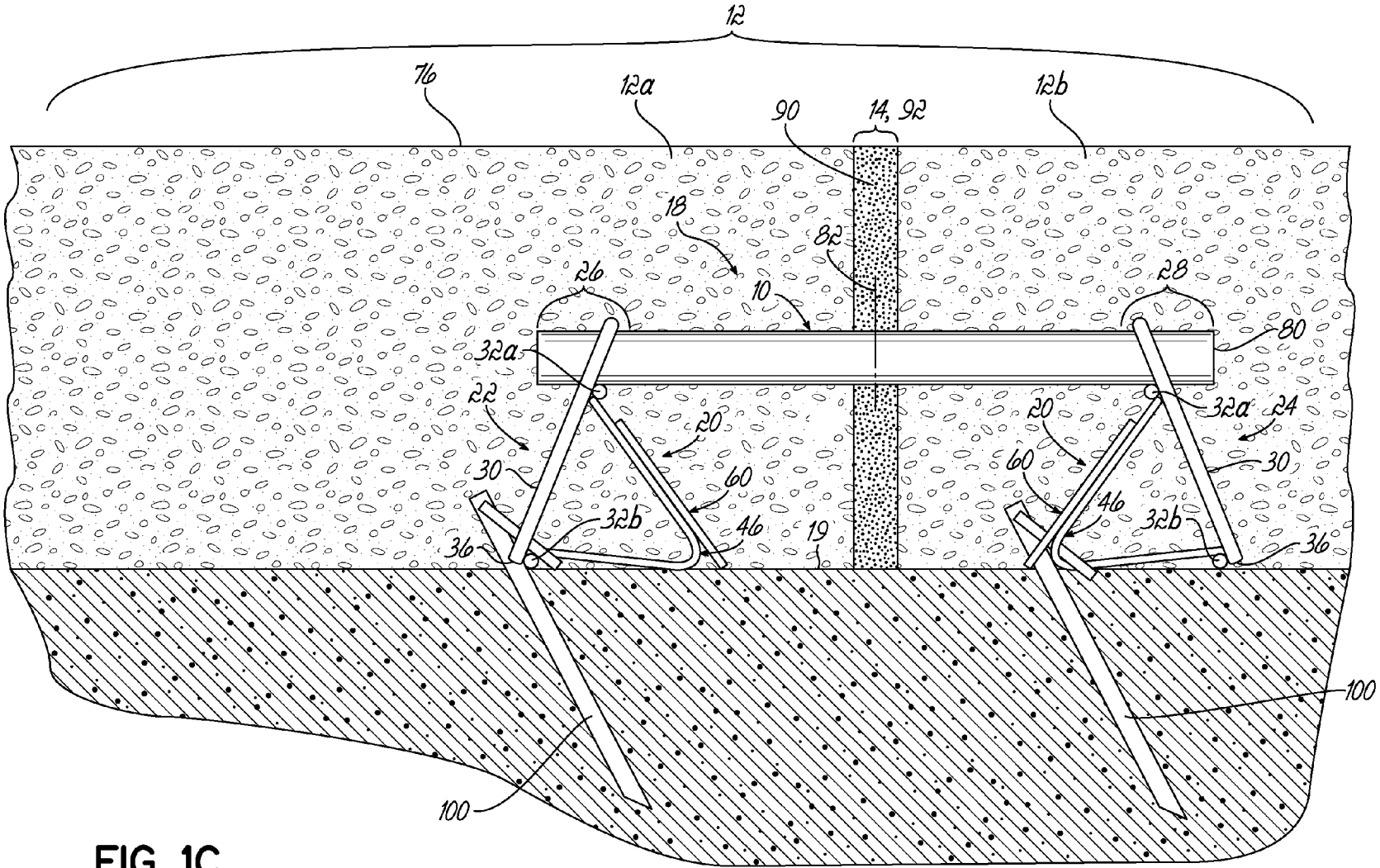
FIG. 1C is a front elevation view in partial cross sectional of an embodiment of a dowel bar assembly with dowel bars extending across an expansion joint between two slabs of pavement in accordance with aspects of the invention.

Referring to FIGS. 1A, 1B, and 1C, dowel bars 10 assist in preventing vertical movement of adjacent concrete slabs 12*a*, 12*b* (collectively designated 12). Dowel bars 10 generally extend across a joint 14 between the adjacent concrete slabs 12. In this way, the concrete slabs 12 are coupled together and a heavy load placed on one of the concrete slabs 12*a*, 12*b* will be transferred more uniformly across both concrete slabs 12. Improperly aligned dowel bars 10 can lead to failure of the concrete slabs 12 at the joint 14. Embodiments of the invention are directed to improved dowel bar assemblies 18 that maintain the proper alignment of dowel bars 10 during the paving process in which the concrete slabs 12 are formed.

As illustrated in FIGS. 1A, 1B and 1C, the dowel bar assembly 18 is positioned on a subsurface 19 in alignment with the planned location of a joint 14 between adjacent concrete slabs 12. The concrete 16, which is typically very dry, is poured and formed around the dowel bar assembly 18. The dowel bar assembly 18 encounters significant forces during the paving process that can result in the dowel bar assembly 18 collapsing or the dowel bars 10 becoming misaligned. Embodiments of the invention include at least one bracing member 20 to reinforce the dowel bar assembly 18 to maintain the alignment of the dowel bars 10 by resisting the forces encounter during the paving process.

As illustrated in FIGS. 1A-6, an exemplary dowel bar assembly 18 includes at least a first side frame 22. In some aspects, the dowel bar assembly 18 further includes a plurality of dowel bars 10 and a second side frame 24. Each dowel bar 10 includes an end portion 26 that is coupled to one of the first or second side frames 22, 24. Typically, one end portion 26 of each dowel bar 10 in an assembly is fixed to one of the first or second side frames 22, 24, such as by welding. The end portion opposite 28 the fixed end portion 26 of the dowel bar 16 is coupled to, but is not fixed to the other of the first or second side frames 22, 24. Typically, in a dowel bar assembly 18, the fixed end portion 26 of the dowel bars 16 alternate between the first and second side frames 22, 24 such that along one side frame member 22, 24, the end portion 26 of every other dowel bar 10 will be fixed to the side frame 22, 24. Accordingly, the unfixed end portions will alternate with the fixed end portions along the same side frame 22, 24. Alternating the fixed ends of the dowel bars between the two side frames allows the dowel bars and respective slabs to move freely in a horizontal direction. If the dowel bars are fastened to both side frames, this movement would be prevented.

In the illustrated exemplary aspects, the side frame 22, 24 is constructed of three main components. The first component includes at least one connector, such as a first connector 30*a* and a second connector 30*b* (collectively referred to as connector 30), that couples to an end portion 26, 28 of one of the dowel bars 10. The second component is a cross member 32*a*, 32*b*, and 332 that combines successive ones of the connectors 30*a*, 30*b* together. The embodiments illustrated in FIGS. 1A-6 and 8 include an upper first cross member 32*a*, 132*a*, 232*a* and a lower second cross member 32*b*, 232*b* that are spaced apart from one another. In an alternative embodiment illustrated in FIG. 7, a single cross member 332 is shown. The third component of the side frame is the bracing member 20, 120, 220, 320.

Figures 2A, 2B:
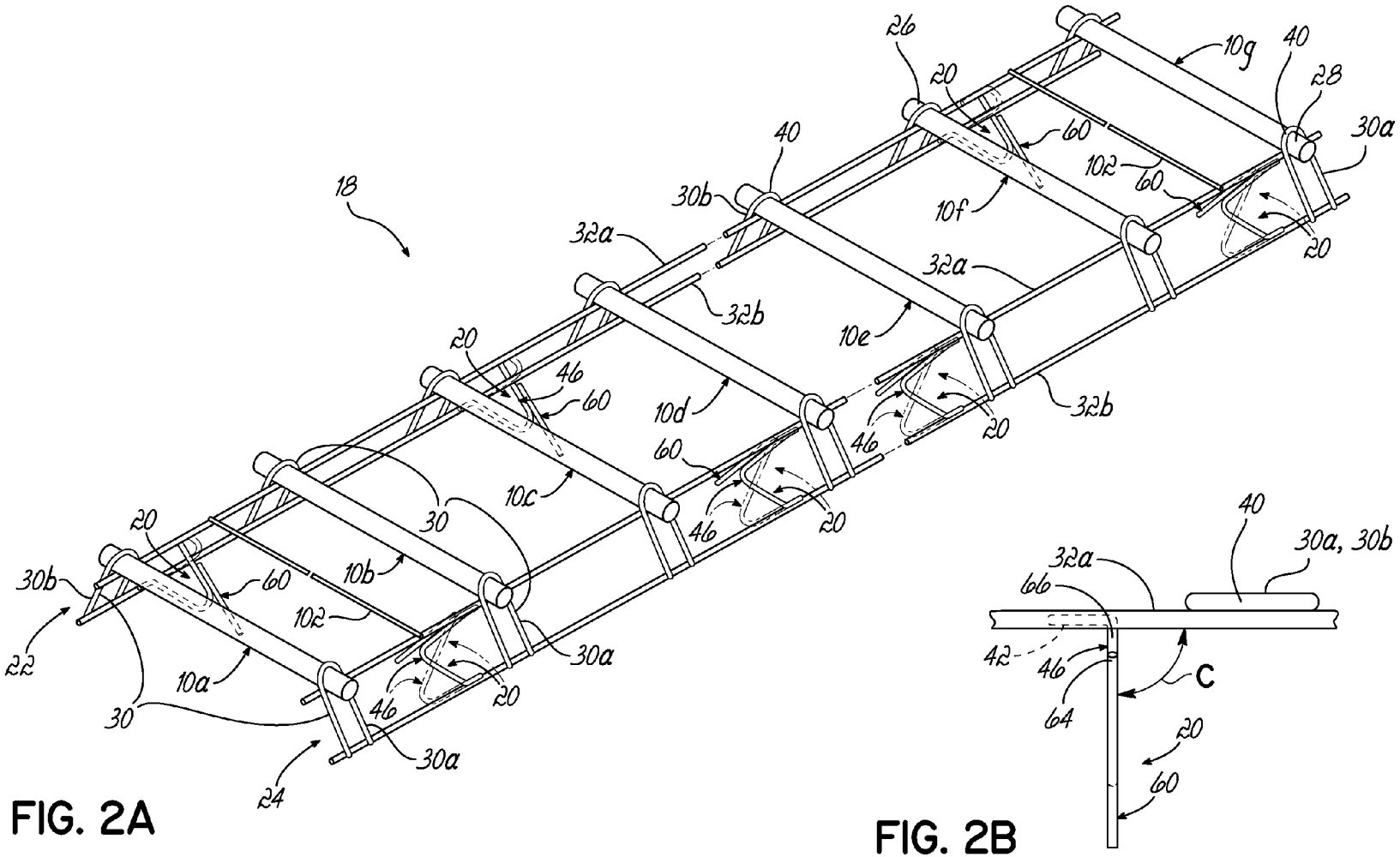
FIG. 2A is a perspective view of an embodiment of a dowel bar assembly in accordance with aspects of the invention.
FIG. 2B is a top elevation view taken along a plane of the side frame of an embodiment of a dowel bar assembly with a bracing member in the deployed position in accordance with aspects of the invention.
Figure 3:
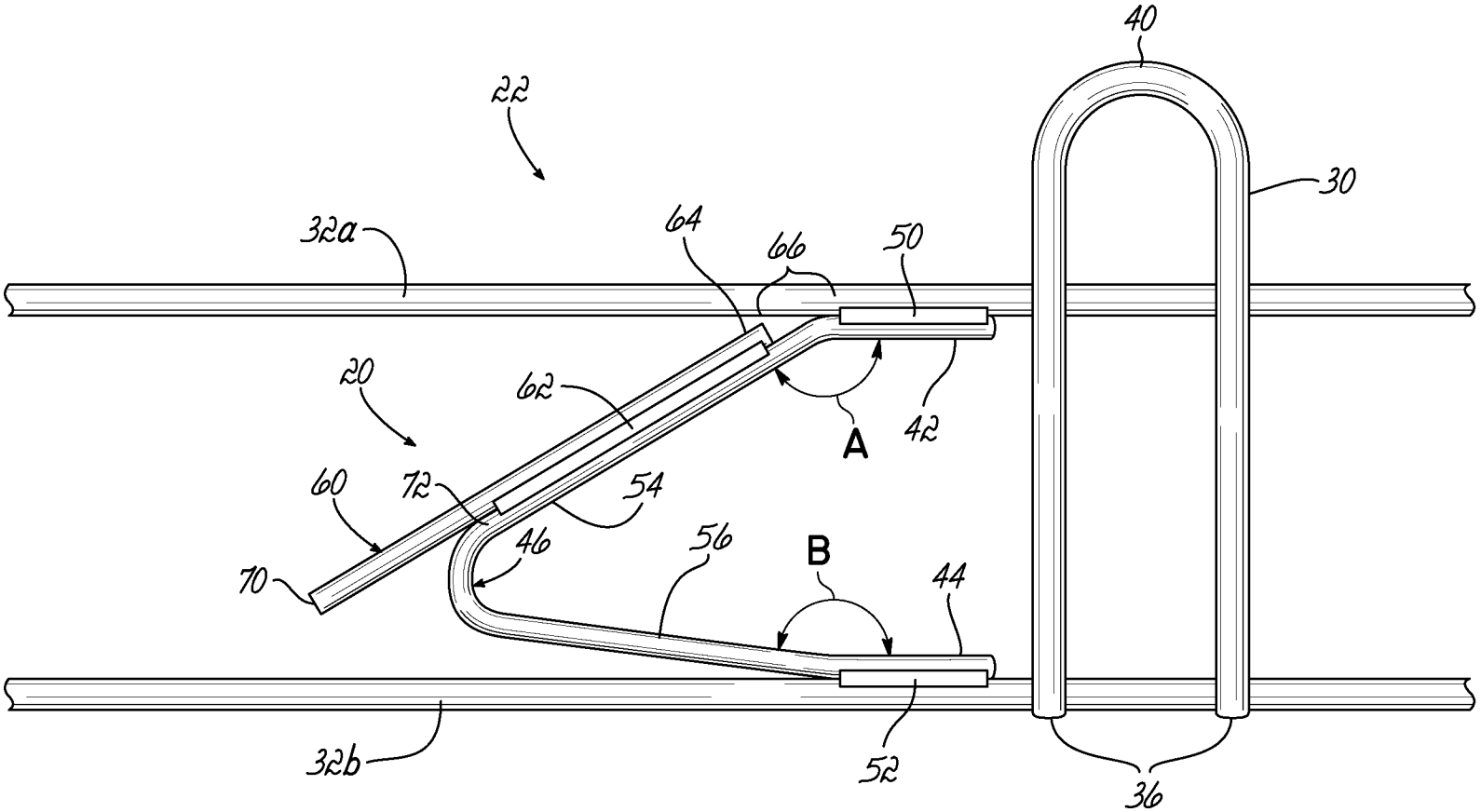
FIG. 3 is a side elevation view of an embodiment of a dowel bar assembly with a bracing member in the stored position in accordance with aspects of the invention.
Figure 4:
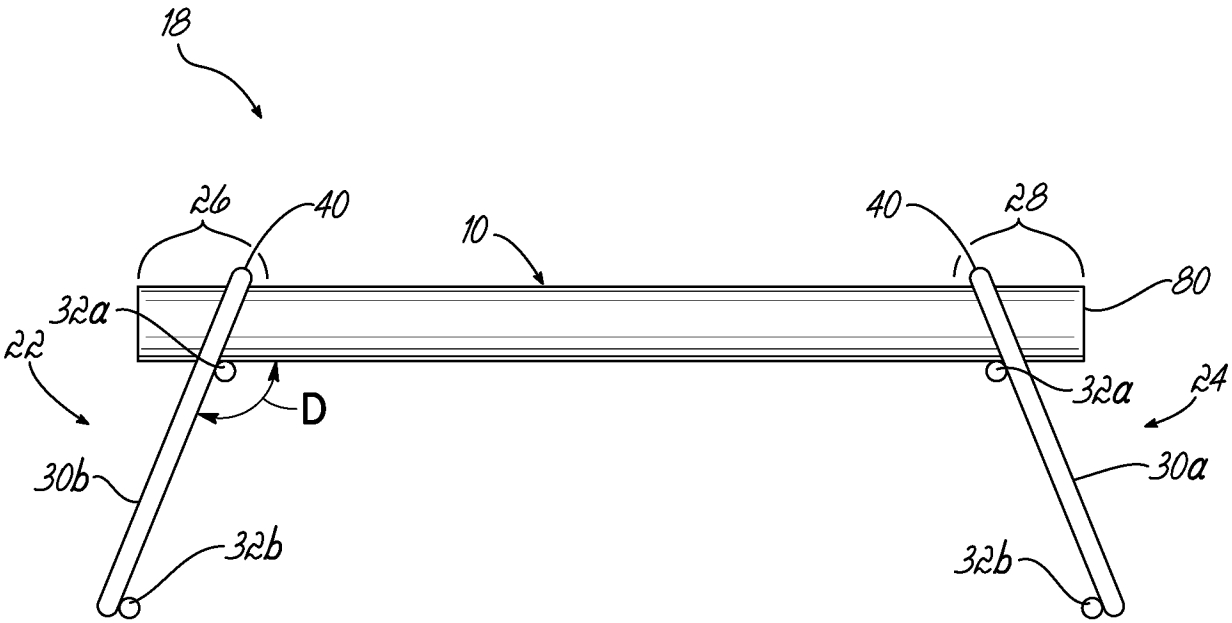
FIG. 4 is a front elevation view of an embodiment of a dowel bar assembly with a bracing member in the stored position in accordance with aspects of the invention.

With reference to FIG. 2A, the connectors 30 are spaced apart and generally parallel with one another to define a side frame plane extending between the connectors 30. In the illustrated aspect, the individual connectors 30*a*, 30*b* have an upside down U shape. The dowel bar 10 may be coupled to the side frame 22, 24 in part, by the curved portion 40 of the connector 30 such that the dowel bar 10 is received within the curved portion 40. As described above, one end portion 26 of the dowel bar 10 may be fixed to one side frame, such as by welding to at least one of the connector 30 or cross member 32*a*, while the other end portion 28 of the dowel bar 10 is reversibly coupled to the other side frame 22, 24. Those of ordinary skill in the art will appreciate that the connector may be in the form of other shapes such as an upside down J shape, upside down V shape, P shape, A shape, or other shape suitable to support a dowel bar above a supporting surface.

The exemplary embodiment illustrated in FIGS. 1-4 and 6 includes an upper first cross member 32*a* and a lower second cross member 32*b*. The upper first cross member 32*a* is fixed to the connectors 30, such as by welding, near to, but spaced apart from, an upper end of the connector 30, such as the curved portion 40, so as to accommodate and optionally assist in coupling the side frame to the end portion 26, 28 of the dowel bar 10. The lower second cross 32*b* member is fixed to the connector 30, such as by welding, proximate a lower end 36 of the connector 30, which during use will be adjacent and fastened to the subsurface for the pavement. In one embodiment, the upper first cross member 32*a* and the lower second cross member 32*b* are spaced apart from each other and are generally parallel. In some embodiments, the space between the upper first cross member 32*a* and the lower second cross member 32*b* may define the cross member plane with the connectors 30.

The side frame 22, 24, further includes at least one bracing member 20 for reinforcing the dowel bar assembly 18 and contacting a support surface, such as the subsurface 19 below the slabs 12. In the exemplary embodiment illustrated in FIGS. 2A and 8, the bracing members 20 are associated with every other connector 30 of the side frame 22, 24. In some embodiments, bracing members 20 are associated with the connectors 30 that are fixed to an end portion of a dowel bar 10. In alternative embodiments, every connector 30 of a side frame 22, 24 is associated with a bracing member 20.

In the exemplary embodiments illustrated in FIGS. 1A-4, the bracing member 20 includes a first end portion 42, a second end portion 44, and an intermediate portion 46 extending between the first and second end portions 42, 44. The first end portion 42 is coupled, such as by a weld 50, to at least one of the cross members 32*a*, 32*b* or a connector 30. The second end portion 44 is coupled, such as by a weld 52, to one of a connector 30 or the other cross member 32*a*, 32*b*. In the exemplary embodiment shown in FIGS. 1A-4, the first end portion 42 is coupled by a weld 50 to the upper first cross member 32*a* and the second end portion 44 is coupled by a weld 52 to the lower second cross member 32*b*. The intermediate portion 46 has an upper arm 54 extending at an angle A from the first end 42 and a lower arm 56 extending at an angle B from the second end 44 such as the upper arm 54 and lower arm 56 converge in a generally V-shape. Angle A may be in a range between about 110 degrees and about 160 degrees and angle B may be in a range between about 110 degrees and about 180 degrees. Angle A and angle B may be the same or different. The upper and lower arms 54, 56 define a bracing member plane.

The intermediate portion of the 46 bracing member 20 is subjected to considerable compressive and tensile forces during the paving process. The bracing member 20 is constructed to resist such forces. While the bracing member resists these forces, it is also constructed to be convertible between a first, stored position (FIG. 3 and shown in phantom in 2A) and a second, deployed position (FIG. 1A-2B) by rotating through angle C. The upper arm 54 of the bracing member 20 is generally exposed to high compressive forces, whereas the lower arm 56 is generally exposed to high tensile forces. The materials typically used to construct dowel bar assemblies 18, such as steel, are more resistant to deformation caused by tensile forces than compressive forces. As such, the upper arm 54 of the bracing member 20 is more likely to deform during the paving process than the lower arm 56. To increase the compressive strength of the upper arm 54 and to increase the ease with which the bracing member 20 is converted between the stored and deployed positions, the intermediate portion 46 in the exemplary embodiment further includes a stiffening member 60 fixed, such as by a weld 62, to the upper arm 54. The stiffening member 60 extends along the length of the upper arm 54. An end 64 of the stiffening member 60 is proximate to, but spaced 66 apart from, the fixed first end 42 of the bracing member 20. This construction allows the stiffening member 60 to sufficiently increase the compressive strength of the bracing member 20, while the space 66 provides an area of relative weakness that allows for the conversion of the bracing member 20 from the stored first position to the second, deployed position. As illustrated in FIG. 2B, during deployment, the bracing member 20 bends at the space 66 between the end 64 of the stiffening member 60 and the fixed area of the first end portion 42. Typically, the bracing member 20 is constructed of a material, such as a steel wire or rod, that is of a similar size or a smaller size than the material used to construct the upper first 32*a* and lower second 32*b* cross members. However, it is understood that the bracing member may be constructed of a heavier or a lighter material, such as a heavier or lighter gauge steel wire or rod, than is used to construct the upper first 32*a* and lower second 32*b* cross members. The size of the wire or rod used for the cross members, connectors, and braces can vary based on the engineering requirements for the particular type of construction being undertaken, as well as on requirements established by state and federal agencies. Typically, the wire or rod cross sectional diameter (or width) ranges between about 0.25 inches to about 0.35 inches. The cross members and connectors are often made of the same dimension wire or rod, but wires or rods of different dimensions may be used. Other materials, such as other metals and alloys, plastics, composites, etc. may be used in the construction of the various components of the side bar assembly.

The stiffening member 60 may also include an end portion 70 that extends beyond the end 72 of the upper arm 54 such that the end portion 70 may contact the subsurface 19 beneath the slab when the bracing member 20 is in the second, deployed position. During use, the extended end portion 70 of the stiffening member 60 may become embedded (not shown) in the subsurface 19, which has the added benefit of resisting a sliding movement of the dowel bar assembly 18 across the subsurface 19 during the paving process. This resistance may be especially helpful when placing concrete on a stabilized subsurface, such as asphalt, and lean or porous concrete.

As illustrated in FIG. 1B, dowel bar assembly 18 is typically designed to position the dowel bars 10 about midway between the upper surface 76 of the pavement and the subsurface 19. Thus, dowel bar assemblies 18 are constructed with side frames 22, 24 having a height specified to accommodate the thickness of pavement into which dowel bars 10 are being embedded. The dowel bar assemblies 18 are also typically constructed such that the lower cross member 32*b* extends a prescribed horizontal distance beyond the end 80 of the dowel 10, such as at least about ⅜ of an inch. Also, the side frame 22, 24 is typically coupled to the end portion 24, 26 of the dowel bar 10 a prescribed distance inside the end of the dowel bar, such as about 1½ inches. This creates an angle D between the plane of the side frame and the longitudinal axis of the dowel bar. The angle D may vary as the height of the side frame 22, 24 increases or decreases to accommodate the thickness of pavement into which dowel bars 10 are being embedded.

The plane of the intermediate portion 46 of the bracing member 20 extends at an angle C, such as about 60 degrees to about 90 degrees, from the plane of the side frame 22, 24 when in the deployed position (FIG. 2B). The angles D and C will factor into the angles A and B of the intermediate portion's upper 54 and lower arms 56.

Another factor affecting the angles A and B is the length of the upper and lower arms 54, 56 of the intermediate portion 46. As described above, the dowel bars 10 allow for the transfer of a load across a joint 14 between adjacent slabs 12 of pavement, while at the same time allowing for thermal contraction and expansion of the adjacent slabs 12 at the joint 14. The joint 14 is typically aligned along the approximate midpoint 82 of the dowel bars 10. Should the bracing member 20 extend across the joint 14 (i.e., beyond the approximate midpoint 82 of the dowel bars 10), the bracing member 20 could span the joint 14 thereby undesirably locking the adjacent slabs 12 together. Thus, when in the deployed position, the upper and lower arms 54, 56 of the bracing member 20 are of a length so that the bracing member 20 does not extend beyond about the midway point 82 of the dowel bars across the joint. Moreover, a portion of the joint 14 is created by the controlled cracking 84 that occurs between the slot 86 cut in the upper surface 76 of the slab 12 and the bottom surface of the slab adjacent the subsurface 19 (FIG. 1B). The controlled crack 84 will form along the path of least resistance. However, if the bracing member 20 extends too close to the approximate midpoint 82 of the dowel bar 10, then the controlled crack 84 may not form in the desired location along the midpoint 82. Thus, in an embodiment of the invention, the bracing member 20 extends from the side frame 22, 24 toward the midpoint 82 of the dowel bar 10 by a distance of up to about 80% of the distance between the end 80 and the midpoint 82. In an alternative embodiment, the bracing member 20 extends from the side frame 22, 24 toward the midpoint of the dowel bar 10 by a distance of up to about 70% of the distance between the end 80 and the midpoint 82. In a further alternative embodiment, the bracing member 20 extends from the end 80 of the dowel bar toward the midpoint of the dowel bar 10 by a distance in the range between about 30% and about 80% of the distance between the end 80 and the midpoint 82. In one embodiment, the bracing member extends no closer than about a 2 inch distance from the dowel midpoint.

The angles A, B, C, and D, as well as the length of the upper and lower arms 54, 56 of the intermediate portion 46 affect the angle E formed between the plane of the side frame 22 and the upper arm 54 of the bracing member 20 when in the deployed position (FIG. 1A). In an embodiment of the invention, angle E is in a range between about 30 degrees and about 60 degrees. In another embodiment, angle E is in a range between about 40 degrees and about 50 degrees. In yet another embodiment, angle E is about 45 degrees.

Figure 5:
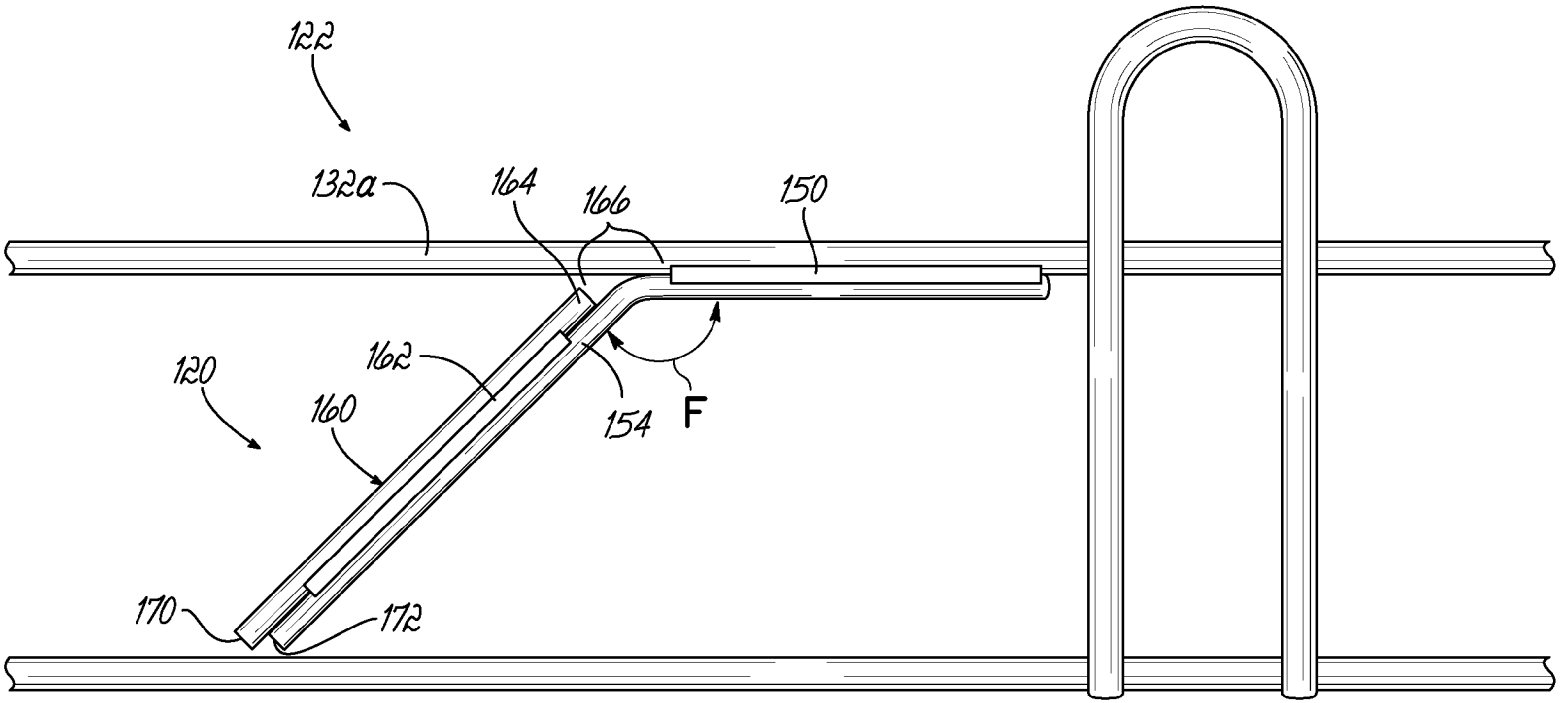
FIG. 5 is a side elevation view of an alternative embodiment of a dowel bar assembly with a bracing member in the stored position in accordance with aspects of the invention.

In an alternative embodiment of the bracing member illustrated in FIG. 5, the bracing member 120 of the side frame 122 includes an arm 154 coupled, such as by weld 150, to the upper cross member 132*a* by an end portion 142. The arm 154 extends from the end portion 154 at an angle F. Angle F may be in a range between about 90 degrees and about 180 degrees. The arm 154 and the first end portion 142 define an initial bracing member plane. The arm 154 further includes an optional stiffening member 160 coupled, such as by weld 162, to the arm 154. An end 164 of the stiffening member 160 is proximate to, but spaced 166 apart from, the fixed end portion 142 of the bracing member 120. This construction allows the stiffening member 160 to sufficiently increase the compressive strength of the bracing member 120, while the space 166 provides an area of relative weakness that allows for the conversion of the bracing member 120 from a stored first position to a second, deployed position. Similar to the embodiment illustrated in FIG. 2B, during deployment, the bracing member 120 bends at the space 166 between the end 164 of the stiffening member 160 and the fixed area of the first end portion 142. The bracing member 120 is configured to contact the subsurface on which the pavement is to be placed such as by an end portion 172 of the arm 154 or an end portion 170 of the stiffening member 160.

Figure 6:
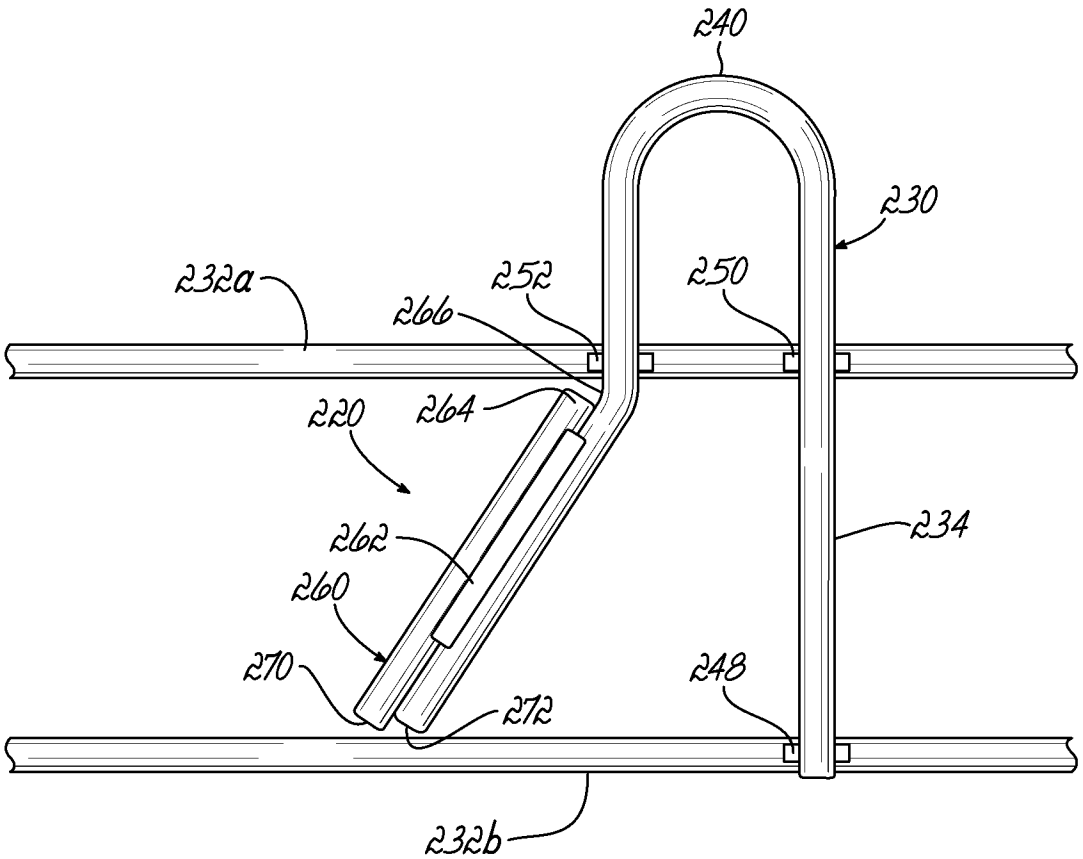
FIG. 6 is a side elevation view of an alternative embodiment of a dowel bar assembly with a bracing member in the stored position in accordance with aspects of the invention.

In another alternative embodiment illustrated in FIG. 6, the bracing member 220 of the side frame 222 is integral with the connector 230. The connector 230 is coupled to an upper first cross member 232*a* and a second lower cross member. The connector includes a first leg 234 coupled to the upper first cross member 232*a* and a second lower cross member 232*b*, such as by welds 248 and 250. The connector 230 also includes a curved portion 240 spaced apart from the upper first cross member 232*a* so as to be capable of receiving an end portion of a dowel bar, such as shown in FIG. 2A. The bracing member 220 extends from the curved portion 240 of the connector 230 at an angle G. Angle G may be in a range between about 30 degrees and about 80 degrees. The bracing member 220 includes an upper end 242 that is coupled, such as by weld 252, to the upper first cross member 232*a*. The bracing member 220 further includes a lower end configured for contacting a subsurface beneath the pavement. The bracing member further includes an optional stiffening member 260 coupled, such as by weld 262, to the bracing member 220. An end 264 of the stiffening member 260 is proximate to, but spaced 266 apart from, the upper end 242 of the bracing member 220. This construction allows the stiffening member 260 to sufficiently increase the compressive strength of the bracing member 220, while the space 266 provides an area of relative weakness that allows for the conversion of the bracing member 220 from a stored first position to a second, deployed position. Similar to the embodiment illustrated in FIG. 2B, during deployment, the bracing member 220 bends at the space 266 between the end 264 of the stiffening member 260 and the fixed area of the first end portion 242. The bracing member 220 is configured to contact the subsurface beneath the pavement such as by an end portion 272 of the bracing member or an end portion 270 of the stiffening member 260.

Figure 7:
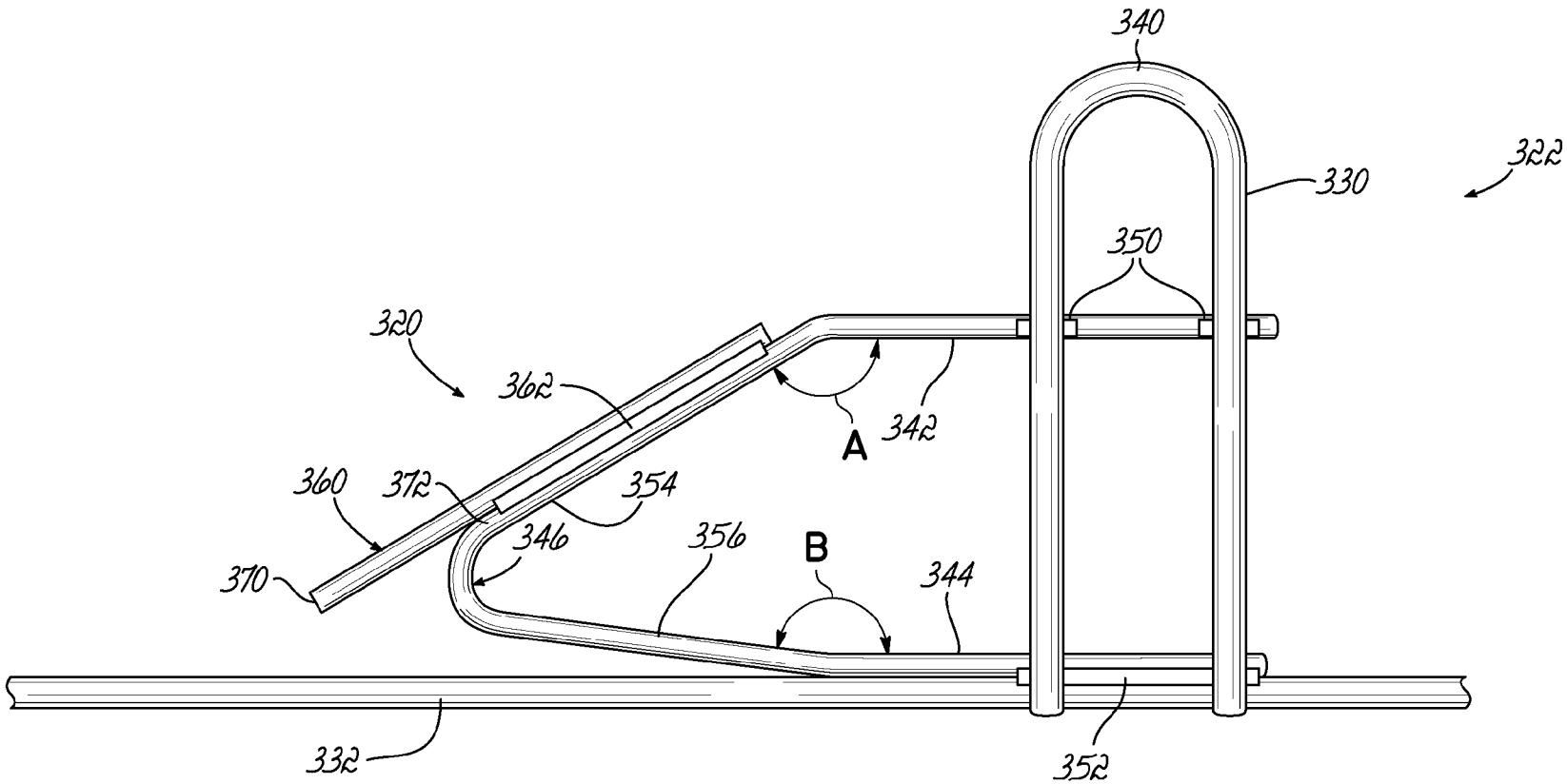
FIG. 7 is a side elevation view of an alternative embodiment of a dowel bar assembly with a bracing member in the stored position in accordance with aspects of the invention.
Figure 8:
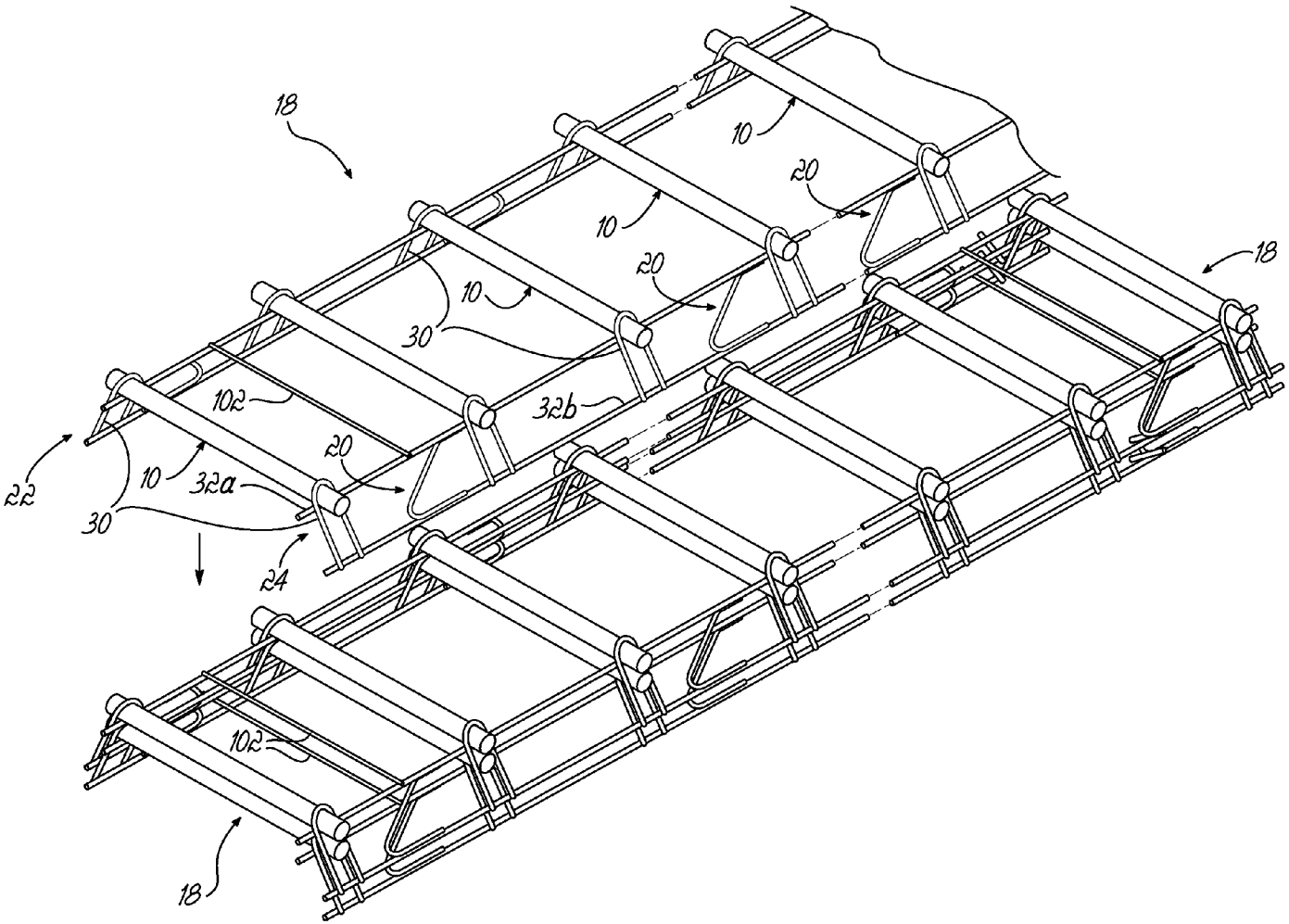
FIG. 8 is a perspective view of a plurality of exemplary embodiments of dowel bar assemblies stacked in accordance with aspects of the invention.

In an alternative embodiment of the side frame, shown in FIG. 7, the side frame 322 includes at least one connector 330 for coupling to an end portion 26 of one the plurality of dowel bars 10, similar to the embodiment shown in FIG. 2A. The side frame may also include a second connector (not shown) also for coupling to an end portion 26 of another of the plurality of dowel bars. The connectors are spaced apart from one another and are generally parallel. The space between connectors 330 defines a connector plane. The alternative embodiment side 322 frame also includes a cross member 332 joining the connectors 330 together. The cross member 332 is fixed to the connectors 330, such as by a weld 350, near an upper end 340 of the connectors. As shown in FIG. 7, the cross member 332 may be fixed to the connectors 330 near an end of the connectors 330 that would be adjacent to a surface on which the assembly is to be situated.

The side frame 322 further includes a bracing member 320 for contacting a surface, such as the subsurface 19 below the slabs 12 in FIGS. 1B and 1C, and reinforcing the dowel bar assembly. In the exemplary alternative embodiment, the bracing member 320 includes a first end portion 342, a second end portion 344, and an intermediate portion 346 extending between the first and second end portions 342, 344. The first end portion 342 is coupled, such as by a weld 350 to the connector 330. The second end portion 344 is coupled, such as by a weld 352, to at least one of a connector 330 or the cross member 332. The intermediate portion 346 has an upper arm 354 extending at an angle A from the first end 342 and a lower arm 356 extending at an angle B from the second end 344 such that the upper arm 354 and lower arm 356 converge in a generally sideways V-shape. Angle A may be in a range between about 110 degrees and about 160 degrees and angle B may be in a range between about 110 degrees and about 180 degrees or less. Angle A and angle B may be the same or different. The upper and lower arms 354, 356 define a bracing member plane. The alternative embodiment of the side frame 322 may be used interchangeably with other embodiments of the side frames, such as side frames 22, 122, and 222.

During storage, transport, or both, the bracing member 20, 120, 220, 320 is in the stored position, i.e., the bracing member 20, 120, 220, 320 is generally parallel to a plane defined by the side frame 22, 122, 222, 322. In an embodiment, the bracing member 20 is coplanar with the plane defined by the side frame 22 (FIGS. 3-7). As illustrated in FIG. 6, when the bracing member 20 is in the stored position, the embodiments of the dowel bar assembly 18 may be stacked. Typically, dowel bar assemblies 18 are packaged by stacking 12 to 15 units together.

As illustrated in FIG. 2B, when needed, the bracing member 20 is converted to the deployed position wherein the bracing member 20 is positioned at an angle (angle C) relative to the plane of the side frame such that the bracing member contacts the subsurface. As illustrated in FIGS. 1A-1C, in some embodiments, the stiffening member 60 contacts the subsurface 19 and may penetrate the subsurface 19. The dowel bar assembly 18 may be converted to the deployed position by bending the intermediate portion 46 until the bracing member 20 is at the desired angle C. The bracing member 20 may be converted to the deployed position either before or after the dowel bar assembly 18 is positioned on the subsurface 19. After the dowel bar assembly 18 is aligned with the planned location of the joint 14, the assembly 18 is anchored to the subsurface (FIG. 1A). Typically, the dowel bar assembly 18 is anchored with stakes 100 or straps and nails at least along the leading edge of the assembly 18 such as along the lower cross member 32*b* of the leading side frame 22 that will first contact the paving material, such as concrete 16, during the paving process (FIGS. 1A-1C). In addition, the dowel bar assembly 18 may also be anchored with stakes 100 or straps and nails on the bracing members 30 extending from the trailing side frame 24 of the assembly 18 (FIGS. 1A-1C).

As illustrated in FIG. 6, the assembly 18 may include an optional shipping wire 102 that extends between the first and second side frames 22, 24. The optional shipping wire 102 holds the assembly 18 together during transport and/or storage. The shipping wire 102 is typically cut prior to starting the paving process so as to not lock up the joint. After the shipping wire 102 is cut, the dowel bar assembly 18 becomes more susceptible to collapsing as the two side frames are no longer coupled to one another except through the dowel bars 10. Each dowel bar 10 is fixed to only one side frame 22 such that the unfixed end of the dowel bar 10 may be easily uncoupled from the opposite side frame 24 thereby causing the assembly 18 to collapse after the shipping wire 102 is cut.

For some paving techniques, after the slab 12 has been placed around the dowel bar assembly 18, a slot 86 is cut into the slab 12 to allow the controlled cracking 84 that forms a contraction joint 88 (FIG. 1B). For other techniques, an expansion joint 90 is formed by the placement of an expansion member 92 in the desired location of the expansion joint 90 before the slabs are poured (FIG. 1C).

While the embodiments illustrated herein include a stiffening member 60, 160, 260, 360 one of ordinary skill in the art will appreciate that the stiffening member may not be necessary on all constructions of the dowel bar assembly 18. For example, the bracing member 20, 120, 220, 320 may be expected to encounter forces requiring reinforcement, or may be constructed of a material or have a structure that does not need reinforcement. Moreover, in the illustrated aspect, at least seven dowel bars 10*a*, 10*b*, 10*c*, 10*d*, 10*e*, 10*f*, and 10*g* are shown in the partial dowel bar assembly of FIG. 2A. Those skilled in the art will readily recognize that any number of dowel bars 10 can be used as may be required to transfer loads between adjacent pavement slabs 12. The dowel bars 10 of the illustrated aspect are shown to be cylindrical. In other aspects, however, other shapes can be used. For example, a rod with another cross sectional shape, such as a square cross-section or even hexagonal cross-section, can be used. Similarly, a variety of materials can be used for the dowel bar 10. For example, the dowel bar 10 can be formed from a metal material, a fiberglass material, and a carbon composite material. In some aspects, a material having anticorrosion properties, such as a coating of epoxy, may be used to prevent corrosion of the dowel bar 10 due to moisture. In some embodiments, the dowel bar 10 may be coated with a bond breaking agent to prevent the dowel bar from bonding with the concrete.

While the present invention has been illustrated by the description of one or more embodiments thereof, and while the embodiments have been described in considerable detail, they are not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method and illustrative examples shown and described. Accordingly, departures may be made from such details without departing from the general inventive concept.

What is claimed is:

1. A concrete pavement dowel bar assembly comprising:

a side frame including at least one bracing member, said side frame further comprising:

a first connector defining a support for a first dowel bar;

a second connector defining a support for a second dowel bar;

a first cross member joining the first connector with the second connector;

a second cross member spaced apart from the first cross member, the second cross member joining the first connector with the second connector, the space between the first and second cross members defining the plane of the side frame; and said at least one bracing member being convertible between a first, stored position and a second, deployed position, wherein when in the stored position, the at least one bracing member is generally parallel to a plane defined by the side frame, and when in the second, deployed position, the at least one bracing member is disposed at an angle relative to the plane of the side frame.

2. The assembly of claim 1, wherein the at least one bracing member further comprises a first end portion coupled to at least one of the first cross member or the first connector, a second end portion coupled to at least one of the second cross member and the first connector, and an intermediate portion extending between the first end portion and the second end portion, wherein the intermediate portion is convertible between the stored first position and the deployed second position.

3. The assembly of claim 1, further comprising a first dowel bar and a second dowel bar, each of the first and second dowel bars having an end portion coupled to the side frame.

4. The assembly of claim 3, wherein each of the first dowel bar and the second dowel bar has a midpoint generally halfway between a first end portion and a second end portion of the dowel bar and the at least one bracing member does not extend beyond the dowel bar midpoint when in the second, deployed position.

5. The assembly of claim 2, wherein the intermediate portion further comprises a first arm extending from the first end portion that converges with a second arm extending from the second end portion.

6. The assembly of claim 5, further comprising a brace stiffener coupled to at least one of the first arm or second arm.

7. The assembly of claim 1, further comprising a second side frame.

8. The assembly of claim 1, wherein the at least one bracing member further comprises an end portion coupled to at least one of the first cross member or the first connector, and an arm extending from the end portion, wherein the arm is convertible between the stored first position and the deployed second position.

9. The assembly of claim 8, further including a brace stiffener coupled to the arm.

10. The assembly of claim 1, wherein the at least one bracing member includes an arm extending from at least one of the first cross members or the second cross member.

11. The assembly of claim 10, wherein the at least one bracing member includes a brace stiffener coupled to the arm.

12. A concrete pavement dowel bar assembly comprising:

a side frame including at least one bracing member, said side frame further comprising:

a first connector defining a support for a first dowel bar;

a second connector spaced apart from the first connector, the second connector defining a support for a second dowel bar, and the space between the first and second connectors defining the plane of the side frame;

a cross member joining the first connector with the second connector; and said at least one bracing member being convertible between a first, stored position and a second, deployed position, wherein when in the stored position, the at least one bracing member is generally parallel to a plane defined by the side frame, and when in the second, deployed position, the at least one bracing member is disposed at an angle relative to the plane of the side frame.

13. The assembly of claim 12, wherein the at least one bracing member further comprises a first end portion coupled to the first connector, a second end portion coupled to at least one of the cross member or the first connector, and an intermediate portion extending between the first and second end portions, wherein intermediate portion is convertible between the stored first position and the deployed second position.

14. The assembly of claim 12, further comprising a first dowel bar and a second dowel bar, each of the first and second dowel bars having an end portion coupled to the side frame.

15. The assembly of claim 14, wherein each of the first dowel bar and the second dowel bar has a midpoint generally halfway between a first end portion and a second end portion of the dowel bar and the at least one bracing member does not extend beyond the dowel bar midpoint when in the second, deployed position.

16. The assembly of claim 12, wherein the intermediate portion further comprises a first arm extending from the first end portion that converges with a second arm extending from the second end portion.

17. The assembly of claim 16, further comprising a brace stiffener coupled to at least one of the first arm or second arm.

18. The assembly of claim 12, further comprising a second side frame.

19. A method of reinforcing a concrete pavement dowel bar assembly, the method comprising:

providing a side frame for the concrete pavement dowel bar assembly, the side frame having a plurality of connectors for connecting to a plurality of dowel bars, a cross member joining the plurality of connectors, and at least one bracing member convertible between a first, stored position and a second, deployed position;

converting the at least one bracing member to the second, deployed position from the first, stored position, wherein when in the stored position, the at least one bracing member is generally parallel to a plane defined by the side frame, and when in the second, deployed position, the at least one bracing member is disposed at an angle relative to the plane of the side frame.

20. The method of claim 19, wherein the at least one bracing member is converted to the deployed position by bending an intermediate portion of the at least one bracing member such that said intermediate portion is configured to contact a support surface.

* * * * *